US010928016B2

(12) United States Patent
Fan

(10) Patent No.: US 10,928,016 B2
(45) Date of Patent: Feb. 23, 2021

(54) FLEXIBLE LED PROJECTION LIGHT

(71) Applicant: GUANGDONG TONGFANG ILLUMINATIONS CO., LTD., Heshan (CN)

(72) Inventor: Baosheng Fan, Guangdong (CN)

(73) Assignee: GUANGDONG TONGFANG ILLUMINATIONS CO., LTD., Heshan (CN)

( * ) Notice: Subject to any disclaimer, the term of this patent is extended or adjusted under 35 U.S.C. 154(b) by 0 days.

(21) Appl. No.: 16/067,582

(22) PCT Filed: Aug. 1, 2017

(86) PCT No.: PCT/CN2017/095441
§ 371 (c)(1),
(2) Date: Jun. 29, 2018

(87) PCT Pub. No.: WO2018/024197
PCT Pub. Date: Feb. 8, 2018

(65) Prior Publication Data

US 2019/0003664 A1 Jan. 3, 2019

(30) Foreign Application Priority Data

Aug. 3, 2016 (CN) ..... 201620839578.0

(51) Int. Cl.
*F21S 4/22* (2016.01)
*F21V 31/00* (2006.01)
(Continued)

(52) U.S. Cl.
CPC ..... *F21S 4/22* (2016.01); *F21V 31/00* (2013.01); *F21V 31/005* (2013.01); *F21V 5/00* (2013.01);
(Continued)

(58) Field of Classification Search
CPC ..... F21S 4/22; F21S 4/24; F21S 4/26; F21V 31/00; F21V 31/005; F21V 23/001; F21V 23/002; F21Y 2115/10
See application file for complete search history.

(56) References Cited

U.S. PATENT DOCUMENTS 7,160,140 B1 * 1/2007 Mrakovich ..... F21V 21/002 439/417
2004/0115984 A1 * 6/2004 Rudy ..... F21V 21/002 439/405
(Continued)

FOREIGN PATENT DOCUMENTS

BE 1018085 A3 5/2010
CN 202082687 * 12/2011 ..... F21S 2/00
(Continued)

OTHER PUBLICATIONS

English Machine Translation of CN 202082687 provided by Espacenet (Year: 2011).*
(Continued)

*Primary Examiner* — Zheng Song
(74) *Attorney, Agent, or Firm* — Womble Bond Dickinson (US) LLP

(57) ABSTRACT

Provided is a flexible LED projection lamp, comprising: a plurality of LED lamp boards (1), wherein the LED lamp board (1) is a circuit board (3) having an LED (2) soldered thereon, each of the LED lamp boards (1) is connected by means of a flexible wire (4), and a lens (6) is arranged above the LED lamp board (1) at a position corresponding to the LED (2); and an injection-type insulating sheath (7), wherein the injection-type insulating sheath (7) comprises a plurality of external injection-type units (8) and a flexible connector (9) that connects two adjacent external injection-type units (8), the external injection-type unit (8) covers the LED lamp board (1) and a part of the lens (6) below a top
(Continued)

of the lens, and the flexible connector (9) covers the flexible wire (4) between two adjacent LED lamp boards (1). The flexible LED projection lamp has optimal bending performance at the position of each flexible connector (9), and is suitable for mounting on various curved objects and is easy to install, has a wide range of application and optimal waterproof performance.

3 Claims, 1 Drawing Sheet

(51) Int. Cl.
*F21V 23/00* (2015.01)
*F21Y 115/10* (2016.01)
*F21V 5/00* (2018.01)

(52) U.S. Cl.
CPC ..... *F21V 23/001* (2013.01); *F21V 23/002* (2013.01); *F21Y 2115/10* (2016.08)

(56) References Cited

U.S. PATENT DOCUMENTS

2005/0227529 A1* 10/2005 Mrakovich ..... H01R 9/03 439/402
2007/0087619 A1* 4/2007 Nall ..... F21V 21/002 439/417
2008/0205059 A1* 8/2008 Tsuji ..... F21V 21/002 362/249.01
2009/0262531 A1* 10/2009 Saha ..... G09F 13/0409 362/240
2010/0210133 A1* 8/2010 Mochizuki ..... H01R 4/183 439/421
2011/0075413 A1* 3/2011 Smith ..... F21S 2/00 362/235
2013/0183779 A1* 7/2013 Pachler ..... F21V 21/002 438/28
2013/0265775 A1 10/2013 Freeman

FOREIGN PATENT DOCUMENTS

CN 203656684 U 6/2014
CN 203686722 U 7/2014
CN 204062961 U 12/2014
CN 104633507 A 5/2015
CN 204756671 U 11/2015
CN 105674170 A 6/2016
EP 1965123 A1 9/2008
EP 2110802 A2 10/2009
EP 2110802 A3 5/2012
WO 2013086680 A1 6/2013
WO WO 2016108799 * 7/2016 ..... F21V 19/00

OTHER PUBLICATIONS

The Extended European Search Report of European Patent Application No. 17836379.2, dated May 6, 2019, 9 pgs.
The International Preliminary Report on Patentability for PCT Application No. PCT/CN2017/095441, dated Feb. 5, 2019, 4 pgs.
State IP Office of PR China—International Search Report of the International Searching Authority, with an English translation dated Nov. 2, 2017 for International Application No. PCT/CN2016/095441 (6 pgs).
State IP Office of PR China—Written Opinion of the International Searching Authority dated Nov. 2, 2017 for International Application No. PCT/CN2016/095441 (3 pgs).

* cited by examiner

FLEXIBLE LED PROJECTION LIGHT

CROSS-REFERENCE TO RELATED APPLICATIONS

This patent application is a U.S. National Phase application under 35 U.S.C. § 371 of International Application No. PCT/CN2017/095441, filed on 1 Aug. 2017, entitled FLEXIBLE LED PROJECTION LIGHT, which claims priority to Chinese Patent Application No. 201620839578.0, filed on 3 Aug. 2016.

TECHNICAL FIELD

The present invention relates to the field of decoration or lighting, and more particularly, to a flexible LED projection lamp that is easy to install, and has a wide range of application and optimal waterproof performance.

BACKGROUND

LED lamps have many advantages such as energy saving, environmentally friendly, long service life, and high luminous efficiency, and they are rapidly replacing traditional lamps.

A Linear LED projection lamp is one of the common LED lamps and widely used in lighting decoration for indoor and outdoor walls of various buildings. An existing kind of linear LED projection lamp is know from the patent document CN204062961U. Such linear LED projection lamp has a rigid lamp body, which is inconvenient to install in some situations, for example, a position where the linear LED projection lamp is required to be folded or bent. In addition, such linear LED projection lamp has a complicated waterproof configuration, and a high cost.

Therefore, it is necessary to make a further improvement to the above linear LED projection lamp.

SUMMARY

An objective of the present invention is to provide a flexible LED projection lamp which is easy to install and has a wide range of application and optimal waterproof performance.

To achieve the above objective, a flexible LED projection lamp is provided, including:

a plurality of LED lamp boards, wherein each LED lamp board comprises a circuit board and an LED soldered on the circuit board, the plurality of LED lamp boards are connected to one another via a flexible wire, and each LED lamp board is provided with a lens at a position corresponding to the LED; and an injection-type insulating sheath, comprising a plurality of external injection-type units, wherein every two adjacent external injection-type units are connected to each other via a flexible connector, each external injection-type unit is adapted to cover one of the plurality of LED lamp boards and a part of a corresponding lens below a top of the corresponding lens, and the flexible connector is adapted to cover the flexible wire between two adjacent LED lamp boards.

Further, the flexible LED projection lamp also includes an internal injection-type unit adapted to cover one of the plurality of LED lamp boards and a part of a corresponding lens below a top of the corresponding lens, and the external injection-type unit is adapted to cover the internal injection-type unit and expose the top of the corresponding lens.

Further, the external injection-type unit has a cross section in a shape of a square, the flexible connector also has a cross section in a shape of a square, the cross section of the flexible connector has a length less than that of the cross section of the external injection-type unit, and the cross section of the flexible connector has a width less than that of the cross section of the external injection-type unit.

Further, each LED lamp board is provided with a lens holder at a position corresponding to the LED lamp, and the lens is fixed on the lens holder.

The present invention achieves the following beneficial effects. According to the present invention, the internal light source is configured in such a way that two adjacent LED lamp boards are connected to each other via a flexible wire, and an insulating sheath is injection-molded on the external of the internal light source. The insulating sheath includes a plurality of injection-type units covering the periphery of each LED lamp board respectively and a flexible connector covering the periphery of the flexible wire, so that the flexible LED projection lamp has optimal bending performance at the position of each flexible connector, and is suitable for mounting on various curved objects, with a wide range of application and easy installation. Both of the LED lamp board and the flexible wire can be sealed by the insulating sheath and the lens integrally connected to the insulating sheath, so that an optimal waterproof performance can be achieved.

It should be noted that any product implementing the present invention is not required to achieve all the above effects at the same time.

BRIEF DESCRIPTION OF DRAWINGS

The present invention may be best understood by reference to the following description of embodiments taken in conjunction with the accompanying drawings.

DETAILED DESCRIPTION

Figure 1:
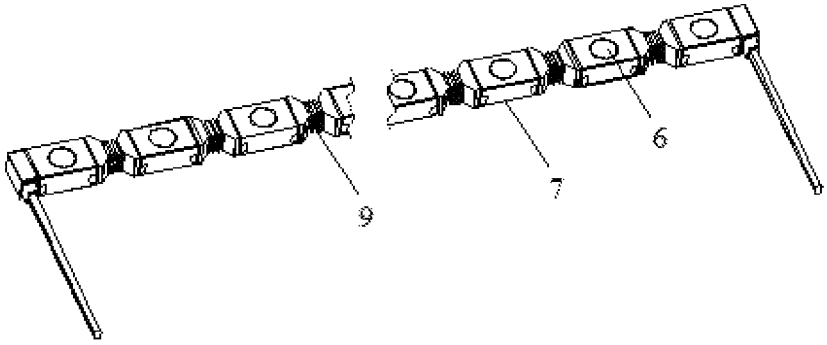
FIG. 1 is a perspective diagram illustrating an embodiment of the present invention.
Figure 2:
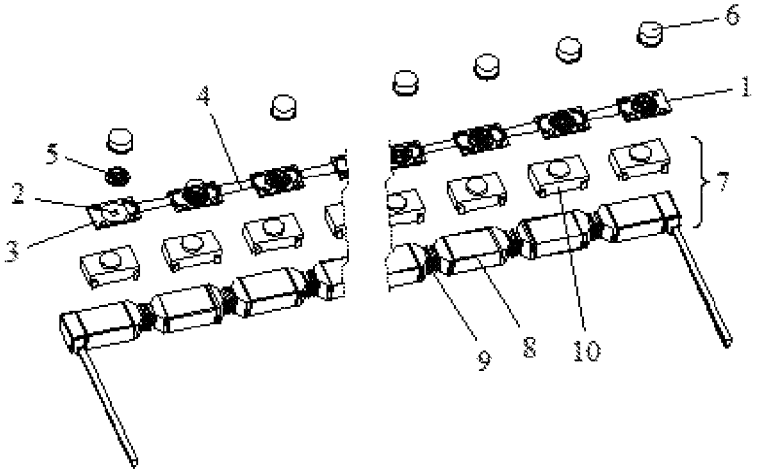
FIG. 2 is an exploded diagram illustrating an embodiment of the present invention.

Referring to a preferred embodiment of the present invention as shown in FIG. 1 and FIG. 2, a flexible LED projection lamp is provided, including:

a plurality of LED lamp boards 1, wherein each LED board 1 includes a circuit board 3 and a single SMD (Surface Mounted Device) LED lamp 2 soldered on the circuit board, the plurality of LED lamp boards 1 are connected to one another via a flexible wire 4, each LED lamp board 1 is provided with a lens holder 5 at a position corresponding to the LED 2, and a lens is arranged on the lens holder fixedly;

an injection-type insulating sheath 7, including a plurality of external injection-type units 8, wherein every two adjacent external injection-type units 8 are connected to each other via a flexible connector 9, each external injection-type unit 8 is adapted to cover one of the plurality of LED lamp boards 1 and a part of a corresponding lens 6 below a top of the corresponding lens 6, and the flexible connector 9 is adapted to cover the flexible wire 4 between two adjacent LED lamp boards 1.

The Flexible LED projection lamp also includes an internal injection-type unit 10 adapted to cover one of the plurality of LED lamp boards 1 and a part of a corresponding lens 6 below a top of the corresponding lens 6, and the external injection-type unit 8 is adapted to cover the internal injection-type unit 10 and expose the top of the corresponding lens 6.

The external injection-type unit 8 has a cross section in a shape of a square, the flexible connector 9 also has a cross section in a shape of a square, the cross section of the flexible connector 9 has a length less than that of the cross section of the external injection-type unit 8, and the cross section of the flexible connector 9 has a width less than that of the cross section of the external injection-type unit 8.

The present invention can achieve the following beneficial effects. According to the present invention, the internal light source is configured in such a way that two adjacent LED lamp boards 1 are connected to each other via a flexible wire 4, and an insulating sheath 7 is injection-molded on the external of the internal light source. The insulating sheath 7 includes a plurality of injection-type units 8, 10 covering the periphery of each LED lamp board respectively and a flexible connector 9 covering the periphery of the flexible wire 4, so that the flexible LED projection lamp has optimal bending performance at the position of each flexible connector 9, and is suitable for mounting on various curved objects, with a wide range of application and easy installation Both of the LED lamp board 1 and the flexible wire 4 are sealed by the insulating sheath 7 and the lens 6 integrally connected to the insulating sheath 7, so that an optimal waterproof performance can be achieved.

Preferred embodiments of the present invention have been described above, but it should be understood that the present invention is not limited to the above embodiments, and alternative embodiments will become apparent to those skilled in the art to which the present disclosure pertains without departing from its scope, as long as these alternative embodiments achieve the technical effects of the present invention.

What is claimed is:

1. A Flexible LED projection lamp, comprising:

a plurality of LED lamp boards, wherein each LED lamp board comprises a circuit board and an LED soldered on the circuit board, the plurality of LED lamp boards are connected to one another via a flexible wire, and each LED lamp board is provided with a lens at a position corresponding to the LED;

an injection-type insulating sheath integrally connected to the lens, comprising:

a plurality of external injection-type units, and a plurality of flexible connectors, wherein every two adjacent external injection-type units are connected to each other via a respective one of the plurality of flexible connectors, each external injection-type unit is adapted to cover a periphery of one of the plurality of LED lamp boards and a part of a corresponding lens below a top of the corresponding lens, and each flexible connector is adapted to cover the flexible wire between two adjacent LED lamp boards; and a plurality of internal injection-type units, wherein each internal injection-type unit is adapted to cover the periphery of the one of the plurality of LED lamp boards and the part of the corresponding lens below a top of the corresponding lens, and the external injection-type unit is adapted to cover a periphery of the internal injection-type unit and expose the top of the corresponding lens, wherein the injection-type insulating sheath and the lens seal the LED lamp board and the flexible wire.

2. The flexible LED projection lamp of claim 1, wherein the external injection-type unit has a cross section in a shape of a square, the flexible connector also has a cross section in a shape of a square, the cross section of the flexible connector has a length less than that of the cross section of the external injection-type unit, and the cross section of the flexible connector has a width less than that of the cross section of the external injection-type unit.

3. The flexible LED projection lamp of claim 1 wherein each LED lamp board is provided with a lens holder at a position corresponding to the LED, and the lens is fixed on the lens holder.

* * * * *